US005855083A

United States Patent [19]

Bilbie et al.

[11] Patent Number: 5,855,083

[45] Date of Patent: Jan. 5, 1999

[54] ERASABLE SIGN

[76] Inventors: James James Frank Bilbie, 298 Oriental Parade, Wellington 6001; Roy Beverley Tipper, 45 The Terrace, Wellington, both of New Zealand

[21] Appl. No.: 537,732

[22] PCT Filed: Apr. 14, 1994

[86] PCT No.: PCT/NZ94/00031

§ 371 Date: Mar. 7, 1996

§ 102(e) Date: Mar. 7, 1996

[87] PCT Pub. No.: WO94/24654

PCT Pub. Date: Oct. 27, 1994

[30] Foreign Application Priority Data

| | | | |
|---|---|---|---|
| Apr. 14, 1993 | [NZ] | New Zealand | 247404 |
| Jun. 17, 1993 | [NZ] | New Zealand | 247918 |
| Dec. 23, 1993 | [NZ] | New Zealand | 250608 |

[51] Int. Cl.[6] ..... G09F 19/00

[52] U.S. Cl. ..... 40/615; 434/410

[58] Field of Search ..... 40/427, 486, 615; 283/72, 81, 94, 98, 102, 901; 434/408, 410, 413, 416, 425

[56] References Cited

U.S. PATENT DOCUMENTS

| | | | |
|---|---|---|---|
| 1,881,140 | 10/1932 | Settel | 434/410 |
| 4,763,929 | 8/1988 | Weil | 434/410 X |

FOREIGN PATENT DOCUMENTS

| | | | |
|---|---|---|---|
| 689870 | 6/1964 | Canada | 434/425 |
| 9201057 | 12/1992 | WIPO | 434/410 |

*Primary Examiner*—Brian K. Green
*Attorney, Agent, or Firm*—Gray Cary; Ware & Freidenrich

[57] ABSTRACT

A sign comprises a base layer and a transparent or translucent upper sheet over the base layer. An icon or indicia of the sign is associated with the base layer or is printed on the upper sheet. The upper sheet and base layer are releasably adhered together under pressure applied on the upper sheet which causes the icon or indicia to be displayed. When the upper sheet is released from the base layer the icon or indicia is erased. In another embodiment the icon or indicia is displayed when the upper sheet is released from the base layer, and is erased when the upper sheet is pressed to adhere to the base layer.

6 Claims, 6 Drawing Sheets

ERASABLE SIGN

FIELD OF INVENTION

The invention comprises an erasable sign. The sign of the invention may be a separate sign or may be an integral part of another product such as a label or book for example.

SUMMARY OF INVENTION

The present invention provides a form of sign which may normally be blank or erased, but can be operated to display a predetermined icon or indicia including one or more words, which can then be erased again at will and so on. The icon or indicia may be any graphical symbol of any type, or any word or words, or any combination of one or more symbol(s) or one or more word(s).

In broad terms in one aspect the invention comprises an erasable sign comprising a base layer comprising a contrasting icon or indicia in or below the base layer and an upper sheet extending over the base layer, the upper sheet and the base layer being releasably adhesive together under pressure applied on the upper sheet, and the base layer icon or indicia being visible through the upper sheet when the upper sheet is caused to releasably adhere to the base layer and being substantially less visible and preferably generally invisible when the upper sheet is released from the base layer.

The base layer may be formed in the shape of the icon or indicia as a positive image of the icon or indicia, or as a negative image, or the icon or indicia may be printed on a surface beneath the base layer as a positive or negative image and the base layer applied over said surface as a clear or substantially clear coating.

In broad terms in another aspect the invention comprises an erasable sign comprising a base layer and an upper sheet extending over the base layer with an icon or indicia printed on the upper sheet, the upper sheet and the base layer being releasably adhesive together under pressure applied on the upper sheet, and the icon or indicia being visible when the upper sheet is released from the base layer and being substantially less visible or generally invisible when pressure is applied on the upper sheet to cause the upper sheet to adhere to the base layer.

The icon or indicia may be printed on the underside or top of the upper sheet, as a positive or negative image.

In broad terms in a further aspect the invention comprises an erasable sign comprising a base layer and an upper sheet extending over the base layer with an icon or indicia printed on the upper sheet as a negative image, the upper sheet and the base layer being releasably adhesive together under pressure applied on the upper sheet, and the icon or indicia being visible when pressure is applied on the upper sheet to cause the upper sheet to adhere to the base layer and being substantially less visible and preferably generally invisible when the upper sheet is released from the base layer. Preferably the icon or indicia image is printed on the upper sheet with a colour which is only a medium contrast with the colour of the base layer, such as a lighter grey if the base layer is a dark grey or a lighter red if the base layer is a darker red, to assist in making the icon less visible or generally invisible when erased.

Preferably in all signs of the invention the upper sheet and base layer are sufficiently releasably adhesive together that both the upper sheet can be caused to adhere to the base layer by pressure applied manually on the upper sheet and also that the upper sheet can be released from the base layer by wiping a users finger or thumb across the top surface of the upper sheet to cause the upper sheet to move relative to the base layer. Preferably in such signs of the invention the upper sheet also extends over a "wipe-start" region adjacent the base layer in which wipe-start region the upper sheet and the base layer are not adhesive together, over which region a users finger or thumb may be placed to begin the finger wipe action to separate the upper sheet from the base layer.

The sign may have a contact adhesive applied to the rear surface or a part of the rear surface of the sign enabling it to be stuck onto any other object or item. Also the sign may form part of an adhesive label also having a label area as well as incorporating a sign of the invention. Alternatively the sign may comprise part of or be a novelty or other card or item having no adhesive rear surface. Alternatively again, instead of having a backing sheet providing a rear surface carrying the base layer, the base layer of the sign and upper sheet above it could be applied directly and permanently to an item during manufacture such as the cover of a folder, a phone card, a ruler or any other solid object.

DESCRIPTION OF DRAWINGS

Preferred forms of signs of the invention will now be described by way of example and without intending to be limiting as to detail, with reference to the accompanying drawings, wherein.

DETAILED DESCRIPTION OF PREFERRED EMBODIMENTS

Figure 1:
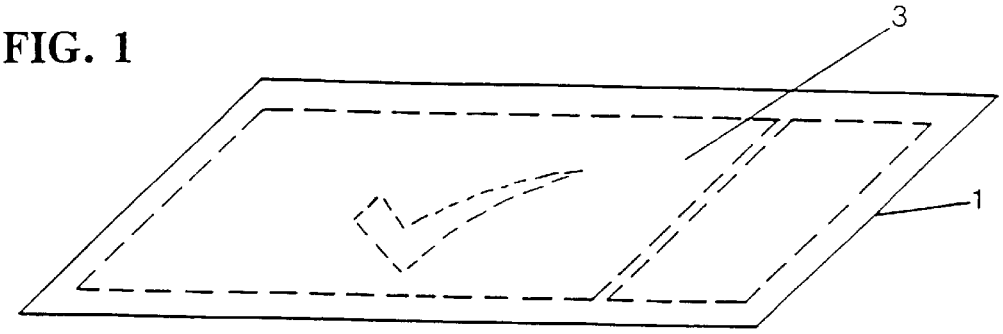
FIG. 1 shows one preferred form of sign of the invention with the upper sheet released from the base layer so that a base layer icon or indicia of the sign is not visible.

Referring to the drawings, the sign of the invention in all cases comprises a base layer 2 and an upper sheet 3 extending over the base layer.

The base layer 2 comprises a layer of wax or similar synthetic material which will adhere with the upper sheet 3 when they are pressed together but which allows the upper sheet 3 to be subsequently released from the base layer 2 as will be described. The base layer 2 may be coated onto a backing sheet Suitable materials for forming the base layer include waxes such as paraffin wax, blends of paraffin wax with other waxes, blends of other waxes, and other substances such as synthetic wax like substances having a waxy consistency, which can be applied as a thin layer and will adhere with the upper layer. Some base layers such as some synthetic wax-like base layers may be coloured by having a dye added, or alternatively the base layer may be made to appear coloured by printing a colour on a substrate and then applying a clear or near clear wax or similar material over the coloured surface to form a coloured base layer.

The base layer may comprise any other suitable material than wax, which however will adhere with the upper sheet 3 under localised pressure but which also allows the upper sheet to be subsequently released from the base layer.

The backing sheet 1 may consist of a layer of light card or paper or plastic or other rigid or non-rigid substrate. The backing sheet 1 may have a coating of contact adhesive on its rear surface or a part of its rear surface by which the sign may be stuck to an object. Alternatively the backing sheet may be the page of a book where the sign is carried by the page of a child's book as a novelty for example, or a novelty card of a series that children may collect, for example.

It is possible that the material of the backing sheet 1 could form the base layer so that the base layer 2 and backing sheet 1 are one and the same. The base layer 2 can also be directly applied to the surface of an object which is to have an erasable sign permanently fixed to or integral with it, such as a rigid file cover or part thereof, a key ring, an in/out notice board or the like.

The upper sheet 3 is preferably translucent and may comprise a translucent plastic film, tracing paper or the like. A clear plastic film may be given qualities of translucence by etching, texturing or calendaring the film and particularly the bottom surface of the film, for example. This may also assist the upper sheet to adhere with the base layer in use. A clear film may also be made translucent by printing the film with a translucent ink or a layer of a conventional opaque ink which is thin enough to make the film appear translucent. The upper sheet 3 may be printed to define a window in the upper sheet for example through which the icon or indicia of the sign is visible. Regions of the upper sheet other than such a window may be provided for carrying permanently printed media such as advertising media.

Most preferred for forming the upper sheet are polyester films or similar materials preferably having a glossy or substantially glossy surface. Preferably the upper sheet is up to 100 microns and most preferably in the range 35 to 65 microns in thicknesses.

A protective top sheet (not shown) may be provided over the upper sheet, comprising clear plastic film for example.

In signs of the invention adjacent the base layer 2 may optionally be provided a wipe-start region 2*a*. In FIGS. 1 & 2, 6 & 7, 10 & 11 and 14 to 16 this wipe-start region 2*a* is indicated by a broken outline. The wipe-start region 2*a* may be formed as shown in FIGS. 4, 5, 9, 13 and 18 by applying no material of the base layer i.e. no waxy or similar material, to the backing sheet 1 beneath the upper sheet 3 in the wipe-start region 2*a*. The region 2*a* may be the same width across the sign as the base layer 2 but could be of less or greater width, and is preferably at least one finger width wide in the direction of erasure along the length of the sign, but could be wider, or longer, for larger signs for example.

Alternatively to provide a wipe-start region the material of the base layer 2 may extend beneath the upper sheet 3 in the wipe-start region 2*a*, and to make the upper sheet 3 and base layer 2 non-adhesive together in the wipe-start region, a coating may be applied to the under surface of the upper sheet 3 in the wipe-start region 2*a*. The coating is a material such as a silicon or any other suitable coating, which will make the upper sheet non-adhesive to the material of the base layer 2. In a variation a coating may be applied to the top surface of the base layer 2 in the wipe-start region 2*a*, instead of applying the coating to the undersurface of the upper sheet 3 also to make the upper sheet 3 and base layer 2 non-adhesive together in the wipe-start region 2*a*.

The upper sheet 3 extends over both the base layer 2, and any wipe-start region 2*a* if provided, and is fixed to the backing sheet 1 about the periphery of the upper sheet, that is along both sides and at either end of the upper sheet, by gluing, plastic welding or other suitable means during manufacture. Small air vents may be provided in the form of one or more slits or pinholes near the periphery of the product such as at or near either end for example, which can assist easy finger wipe action of the product. Alternative to fixing the upper sheet about the entire periphery upper sheet, the upper sheet may be fixed along at least two opposite sides of the upper sheet or at least most of two opposite sides (in the case of a square or rectangular erasable product) but it is preferred to fix the upper sheet about most or all of the periphery of the upper sheet.

Other forms of sign of the invention may comprise a wipe-start region on two sides of or around all or nearly all of the periphery of the erasable sign. The signs need not be square or rectangular in shape but could be circular in overall shape for example.

In the sign of FIGS. 1 to 4 the base layer 2 is formed in the shape of an icon or indicia such as the tick shown in the drawings. The icon or indicia instead of being the tick shown could be any other letter, word, number, symbol or the like.

The icon or indicia may be made to have a contrasting colour, for example, by incorporating a dye in the wax of the base layer.

In use the upper sheet 3 is pressed down by pressing and repeatedly running a fingernail or stylus over the upper sheet 3 for example, to block or scribble in the required area. This will cause the upper sheet 3 to adhere to the base layer icon or indicia 2 so that the icon or indicia is then clearly visible through the translucent upper sheet 3, as shown in FIG. 2.

Figure 2:
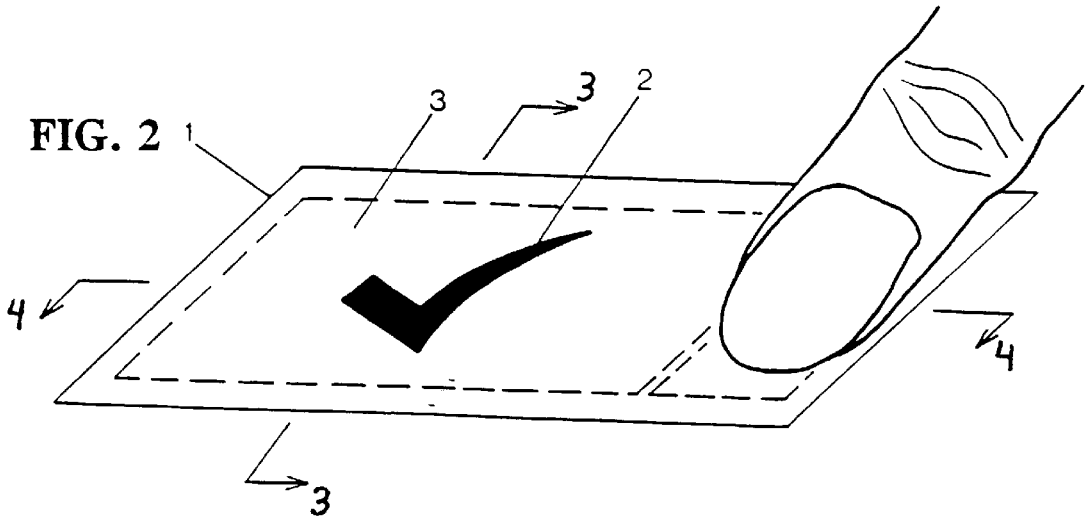
FIG. 2 shows the sign of FIG. 1 with the upper sheet adhered to the base layer so that the icon or indicia is visible and showing the start of finger wipe action to release the upper sheet from the base layer to again erase the icon or indicia.
Figure 3:
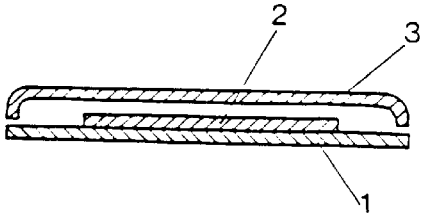
FIG. 3 shows the sign of FIGS. 1 and 2 in cross-section along line 3—3 of FIG. 2.
Figure 4:
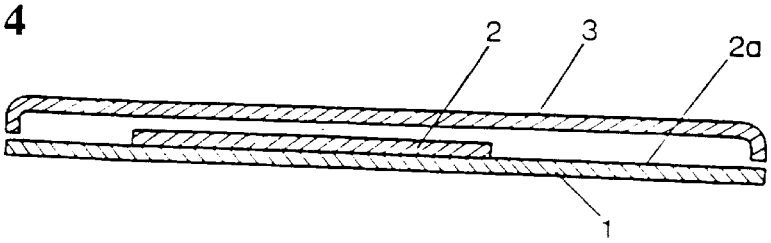
FIG. 4 shows the sign of FIGS. 1 and 2 in cross-section along line 4—4 of FIG. 2.

To erase the icon or indicia so that it is substantially less visible or generally invisible, a user's finger or thumb is wiped across the top surface of the upper sheet 3 from a wipe-start region 2*a* if provided as shown in FIG. 2. Even though the top surface of the sign may be substantially smooth this will separate the upper sheet 3 from the base layer 2 as the users finger moves, making the icon or indicia substantially invisible as shown in FIG. 1. In FIG. 1 the tick is shown in phantom outline for illustrative purposes only.

Instead of the base layer 2 being formed in the shape of the desired icon or indicia as shown in FIGS. 1 to 4, the icon or indicia may be ink printed beneath the base layer and the base layer may then comprise a coating of clear or near clear wax or similar over the whole of the backing sheet (except any wipe-start region 2*a*). When the upper sheet is pressed against the base layer by repeatedly running a finger nail or stylus over the upper sheet 3 for example, the upper sheet will adhere to the base layer and the ink printed icon or indicia behind the base layer will become visible through the upper sheet. The sign is erased as before.

As well as being translucent the upper sheet may be tinted with a different colour relative to the colour of the base layer icon or indicia, so that when separated from the base layer the upper sheet appears to have the colour of the upper sheet and when adhered to the base layer the icon or indicia appears either in the colour of the base layer or in a colour resulting from the combination of the base layer and upper sheet colour. For example, the base layer may be coloured blue and the upper sheet toned yellow; when pressed or adhered together the icon or indicia will appear green in contrast to the balance of the yellow upper sheet. The colours may be luminescent or fluorescent. The upper sheet may also be made luminescent or fluorescent or may be lightly embossed with a pattern or logo for example which may be present as a hologram printed onto the upper sheet.

Also, to assist in making the icon or indicia less visible when the upper sheet 3 is not adhered to the base layer 2 colour of the icon or indicia may be made only medium contrast rather than high contrast, and also the top side or under side of the upper sheet 3 may have printed onto it a pattern of small dots or wavy lines or similar which will tend to hide any shadowy image of the icon or indicia that may still be visible through the upper sheet. Such a pattern of dots or wavy lines or similar should not be sufficiently dense or large to obscure the icon when the upper sheet is pressed to adhere to the base layer 2 to make the icon visible. Such a pattern of dots or wavy lines or similar may be printed with a translucent ink, or even with an opaque ink where the pattern is not too dense.

Figure 5:
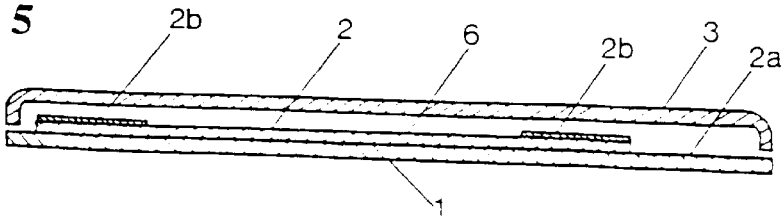
FIG. 5 shows another preferred form of sign of the invention similar to that of FIGS. 1 to 4, in cross-section.

FIG. 5 shows a preferred form of sign similar to that of FIGS. 1 to 4 in that an icon or indicia is visible when the upper sheet 3 is pressed down for example by pressing and repeatedly running a fingernail or stylus over the upper sheet 3 to block or scribble in the required area, and is erased so as to be substantially less visible or generally invisible when a users finger or thumb is wiped across the top surface of the upper sheet 3 from the wipe-start area 2*a*. However, in the sign of FIG. 5 the coloured base layer 2 is continuous (other than in the wipe-start region 2*a*) and a coating 2*b* is applied over the top of the base layer 2 except in a region defining the shape of the icon 2 i.e. the coating is applied as a negative image of the icon on top of the base layer 2 (but the coating 2*b* could also be applied as a positive image). When the upper sheet 3 is pressed down by running an object over the upper sheet 3 the upper sheet 3 will adhere to the base layer where the coating 2*b* is not applied but will not adhere to the coating 2*b* so that the icon or indicia will be visible through the upper sheet. To erase the icon or indicia so that it is no longer visible or at least substantially less visible a user's finger or thumb is wiped across the top surface of the upper sheet 3 from the region 2*a* as before.

FIGS. 6 to 9 show another preferred form of sign of the invention. In this form an icon or indicia is printed on the upper sheet 3, which is shown in the drawings as a tick printed on the underside of the upper sheet 3 as a positive image—see FIGS. 8 and 9 at 6. Alternatively the area around the icon on indicia such as the tick may be printed so that the icon or indicia appears as a negative image, i.e. the icon or indicia itself remains as the translucent material with the icon or indicia possibly being given a tint of for example yellow or orange by printing (without loss of the translucent quality). The icon or indicia may be printed on the top side or underside of the upper sheet 3.

Figure 6:
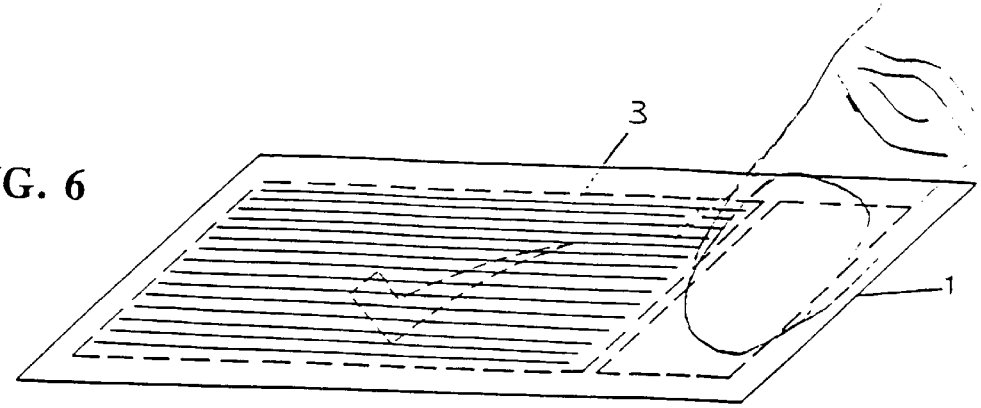
FIG. 6 shows a preferred form of sign of the invention with the upper sheet adhered to the base layer so that an upper sheet icon or indicia is not visible and showing the start of finger wipe action to release the upper sheet from the base layer to make the icon or indicia visible.

To cause the icon or indicia such as the tick to become substantially less visible or generally invisible, the upper sheet 3 is pressed against the backing sheet, for example by pressing and repeatedly running a fingernail or suitable stylus over the upper sheet to block or scribble in the required area. This will cause the upper sheet 3 to adhere to the base layer 2 and the icon or indicia will then merge into the colour of the base layer where the icon or indicia has been printed as a positive image, or the colour of the base layer will become visible through the icon or indicia when printed as a negative (translucent) image so that the entire area about the icon or indicia will be blocked out, in a dark colour if the base layer is also a dark colour for example, as shown in FIG. 6. In FIG. 6 the icon or indicia which is a tick is shown in phantom outline for explanatory purposes.

Figure 7:
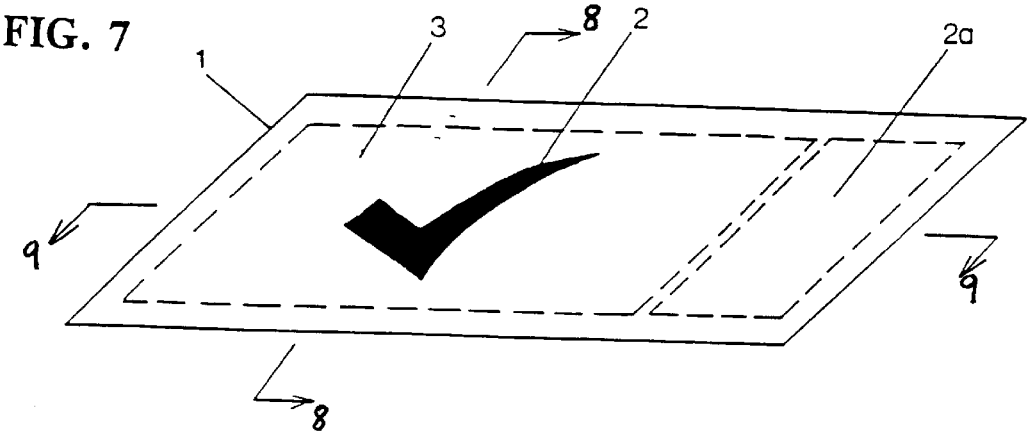
FIG. 7 shows the sign of FIG. 6 with the icon or indicia visible.
Figure 8:
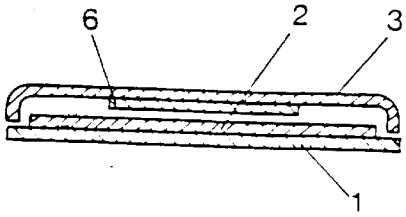
FIG. 8 shows the sign of FIGS. 6 and 7 in cross-section along line 8—8 of FIG. 7.
Figure 9:
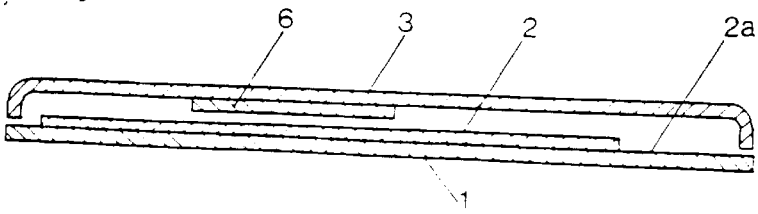
FIG. 9 shows the sign of FIGS. 6 and 7 in cross-section along line 9—9 of FIG. 7.

To cause the icon or indicia to appear, a user's finger or thumb is wiped across the sign in the same way as previously described, from a wipe-start region 2*a* if provided, as shown in FIG. 6. This will separate or release the upper sheet 3 from the base layer 2 as the user's finger moves, so that the icon or indicia will again become visible, as shown in FIG. 7.

Figure 10:
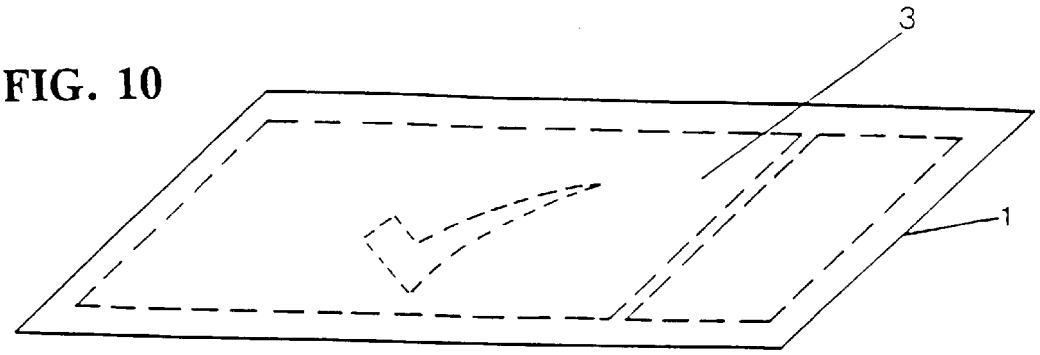
FIG. 10 shows another form of sign of the invention with the upper sheet released from the base layer so that an upper sheet icon or indicia is not visible.
Figure 11:
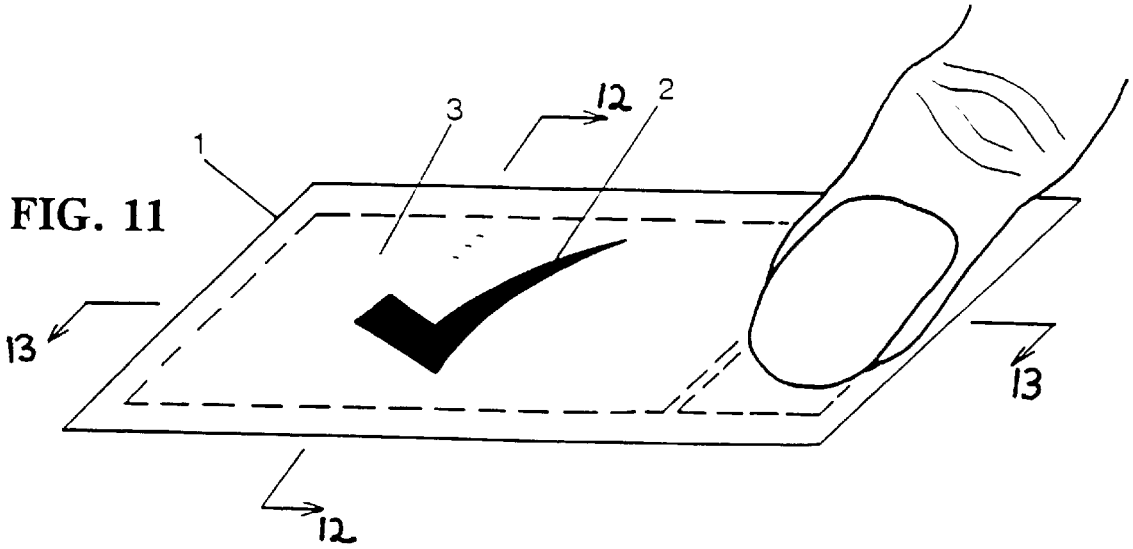
FIG. 11 shows the erasable sign of FIG. 10 with the upper sheet adhered to the base layer so that an upper sheet icon or indicia is visible and showing the start of finger wipe action to release the upper sheet from the base layer to make the icon or indicia not visible.
Figure 12:
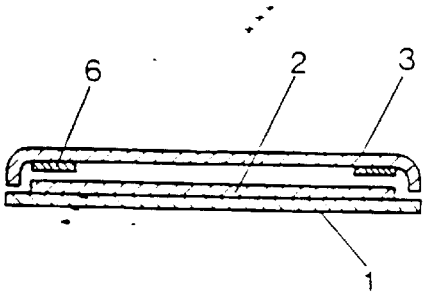
FIG. 12 shows the sign FIGS. 10 and 11 in cross-section along line 12—12 of FIG. 11.
Figure 13:
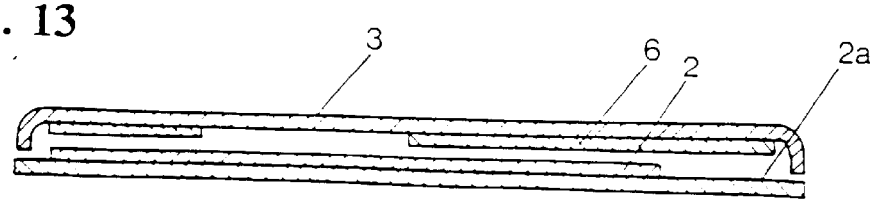
FIG. 13 shows the sign of FIGS. 10 and 11 in cross-section along line 13—13 of FIG. 11.

FIGS. 10 to 13 show yet another preferred form of sign of the invention. In this form an icon or indicia is printed as preferably a negative image 6 (or alternatively a positive image) on the upper sheet 3, preferably on the under side of the upper sheet 3. An icon or indicia is shown in the drawings as a tick printed on the under side of the upper sheet 3 as a negative image—see FIGS. 12 and 13. To cause the icon or indicia to appear, the upper sheet 3 is pressed against the backing sheet, for example, by pressing and repeatedly running a fingernail or suitable stylus over the upper sheet. This will cause the upper sheet 3 to adhere to the base layer 2 so that the colour of the base layer will appear through the upper sheet 3 where it is not printed with the layer 6, to form the icon or indicia, as shown in FIG. 11. To cause the icon or indicia to become substantially less visible or generally invisible, a user's finger or thumb is wiped across the sign in the same way as previously described, from a wipe-start region 2*a* if provided, as shown in FIG. 11. This will separate the upper sheet 3 and the base layer 2 as the user's finger moves, so that the icon or indicia will become invisible or less visible, as shown in FIG. 10. Also as mentioned previously, a pattern which will tend to obscure the icon image i.e. the colour of the base layer through the upper sheet 3 when the icon has been erased, may be printed on to the upper sheet 3, for example on to the top surface, such as a pattern of dots or wavy lines or similar.

FIGS. 14 to 18 show a further sign of the invention. In this form the base layer 2 is either itself formed in the shape of an icon or indicia (a positive image as shown or alternatively a negative image) such as the word APPLE, or the icon or indicia such as the word APPLE is printed in a contrasting colour below a layer of clear or near clear wax or similar coated over the printed icon or indicia, as in the sign of FIGS. 1 to 5. An upper sheet icon or indicia, which in this case is an apple shape in-negative image, is printed on the top sheet, which is shown in the drawings printed on the underside of the upper sheet at 6 (see FIG. 18). The upper sheet icon or indicia could alternatively be a positive image.

Figure 14:
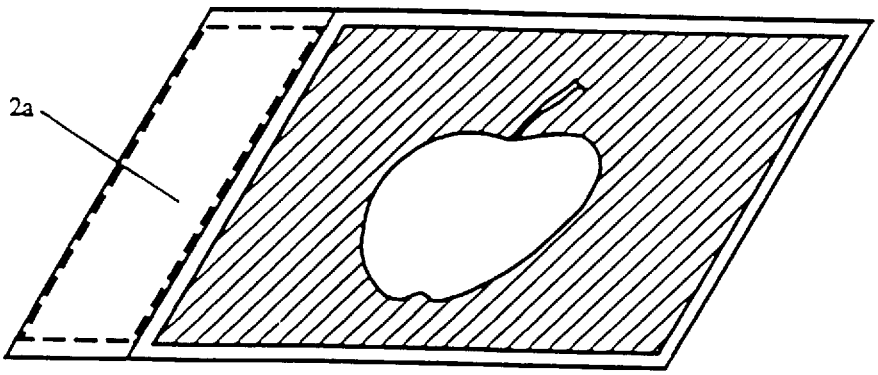
FIG. 14 shows another preferred form of sign of the invention in one state i.e. with the upper sheet released from the base layer so that an upper sheet icon (an apple shape in negative image) is visible and an indicia of the base layer is not visible.
Figure 15:
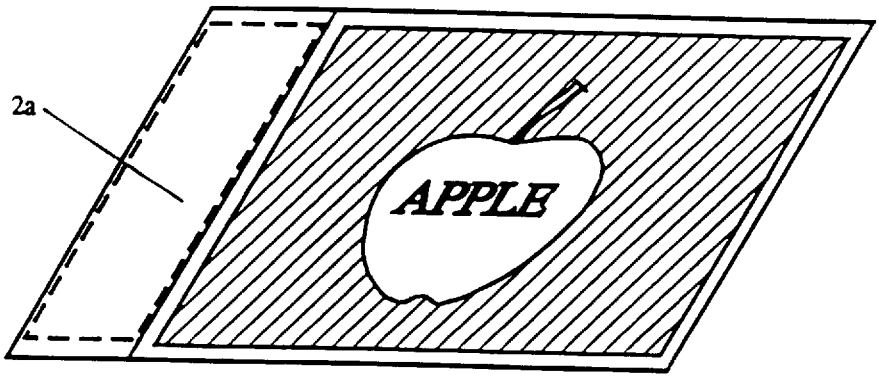
FIG. 15 shows the sign of FIG. 14 with the upper sheet adhered to the base layer so that the base layer icon or indicia (the word "apple") is visible within the negative image upper sheet icon.

In use when the upper sheet 3 is pressed against the backing sheet 1 the upper sheet will adhere to the base layer 2 so that the icon or indicia of the base layer, which in this case is the word APPLE, becomes visible through the window in the upper sheet 3 as shown in FIG. 15, the window in this case being in the shape of an apple. The sign of FIGS. 14 to 18 is essentially same as that of FIGS. 1 to 5 with the addition of a window in the upper sheet which is preferably a negative image window interrelated to the base layer icon or indicia.

To change the sign so that the base layer icon or indicia is substantially less visible or generally invisible, a users finger or thumb is wiped across the top surface of the label, from a wipe-start region 2*a* if provided. This will separate the upper layer 3 and the base layer 2 as the user's finger moves, so that the icon or indicia of the base layer i.e. the word APPLE in this case, is no longer visible or is less visible through the window in the upper sheet, but the window in the shape of the apple (or any other icon or indicia) will still be visible as shown in FIG. 14.

Figure 16:
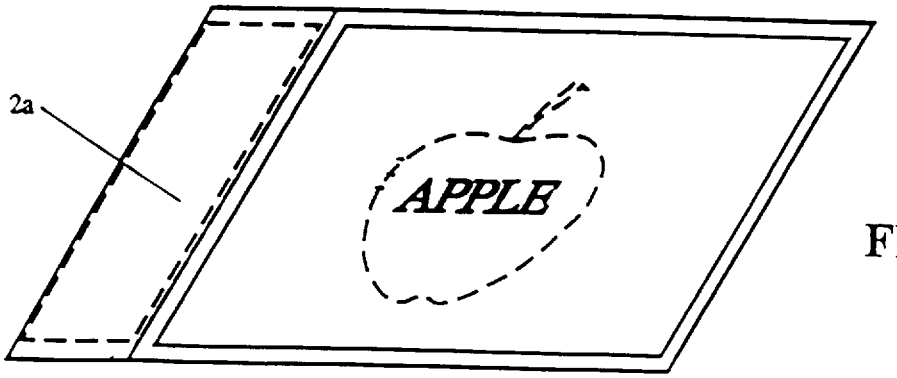
FIG. 16 shows a sign similar to that of FIGS. 14 and 15 but slightly different, with the upper sheet pressed against the base layer so that the base layer icon or indicia is visible but (in this version) the upper sheet icon or indicia is less visible.
Figure 17:
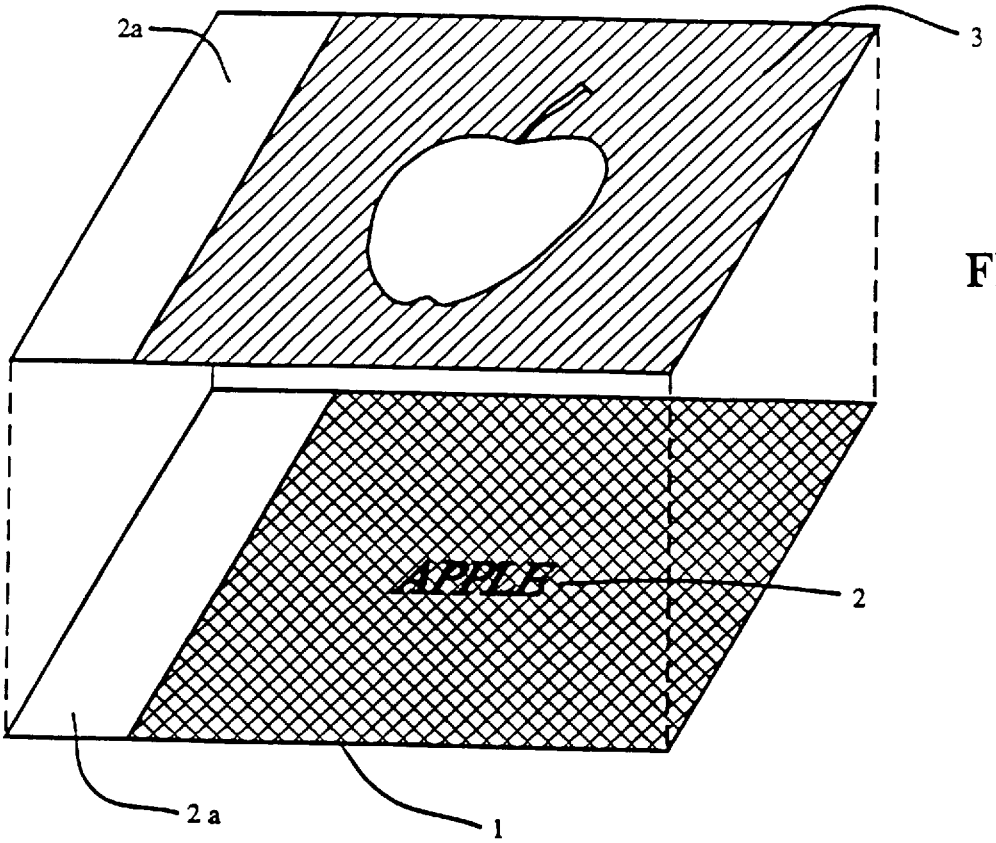
FIG.17 is an exploded view of the sign of FIGS. 14
Figure 18:
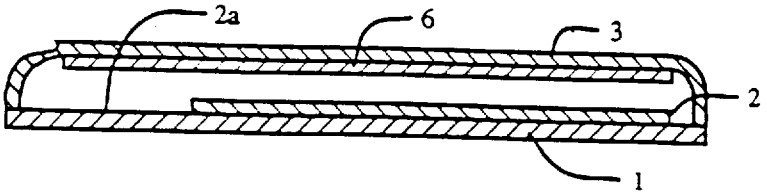
FIG. 18 shows the sign of FIGS. 14 to 17 in cross-section.

In the sign of FIGS. 14, 15 and 17 the negative image printed on the upper sheet 3 is printed with an opaque or relatively opaque ink so that the upper sheet outside of the apple shaped window is opaque. Alternatively as shown in FIG. 16, the negative image on the upper sheet may be printed with a translucent ink, or with a thin layer of a conventional ink so as to give the quality of translucence or in a colour that will match the apparent colour of the base material when seen through the top layer adhered to the base layer. When the upper sheet is not adhered to the base layer the sign will appear similar to as in FIG. 14 (although the surrounding area of the upper sheet may not be quite as prominent). When the upper sheet is "blocked in" with a blunt stylus or similar to cause it to adhere to the base layer so that the base layer icon or indicia becomes visible, the colour of the base layer will show through the translucent top sheet surrounding the window, or alternatively a colour which is a combination of the base layer colour and the upper sheet colour will be apparent surrounding the window. The edges of the window itself will not be clearly visible, as shown in FIG. 16.

In yet a further form of the sign of FIGS. 14 to 18 referred to previously the coloured base layer is continuous (other than in a wipe-start region) and a coating is applied over the top of the base layer except in a region defining the shape of the base layer icon or indicia i.e. the coating is applied as a negative image of the icon on top of the base layer (but the coating could also be applied as a positive image) When the upper sheet is pressed down by running an object over the upper sheet the upper sheet will adhere to the base layer where the coating is not applied but will not adhere to the coating so that the icon or indicia will be visible through the upper sheet. To erase the icon or base layer indicia so that it is no longer visible a user's finger or thumb is wiped across the top surface of the upper sheet as before.

Again, to assist in making the base layer icon or indicia less visible when the upper sheet is not adhered to the base layer, the colour of the base layer icon or indicia may be made only medium contrast rather than high contrast, and also the top side or under side of the upper sheet may have printed onto it a pattern of small dots or wavy lines or similar which will tend to hide any shadowy image of the base layer icon or indicia that may still be visible through the upper sheet. Such a pattern of dots or wavy lines or similar should not be sufficiently dense or large to obscure the icon when the upper sheet is pressed to adhere to the base layer to make the icon visible.

Instead of being printed as a window on the upper sheet the upper sheet icon or indicia may be printed as for example a positive image to one side or above or below the area of the upper sheet where the base layer icon or indicia is visible when the upper sheet is blocked in onto the base layer. For example, the upper sheet icon or indicia may comprise a positive image of an apple which is printed to one side of where the word APPLE of the base layer is visible in one state of the sign. When the sign is finger-wiped so that the upper sheet is separated from the base layer the base layer APPLE word becomes not visible, but the apple image on the top sheet is visible. The icon or indicia on the top sheet may be printed so as to be always visible or so as to become invisible or less visible when the state of the icon is changed, by merging into the colour of the surrounding base layer colour.

Figure 19:
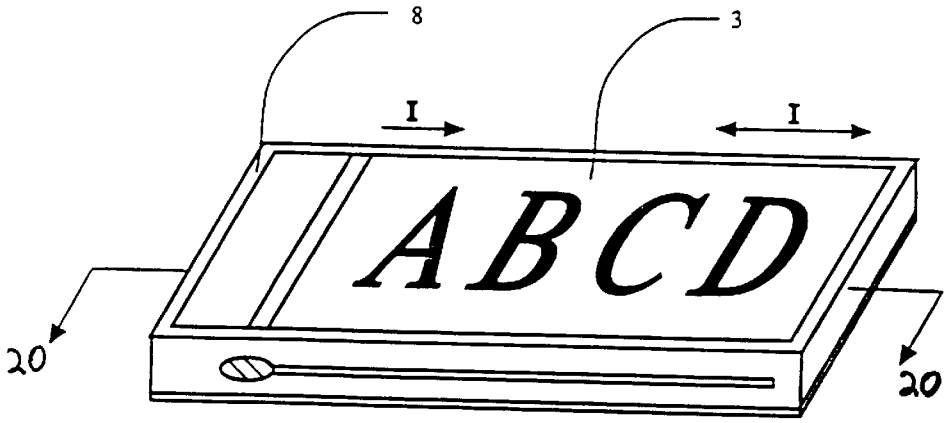
FIG. 19 shows a further sign of the invention having a small sliding cursor operating between the upper sheet and base layer of the sign for erasure.
Figure 20:
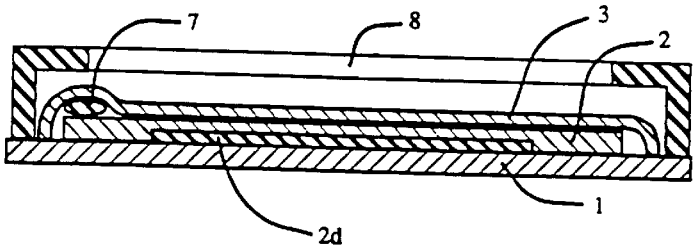
FIG. 20 shows the sign of FIG. 19 along line 20—20 of FIG. 19.

FIGS. 19 & 20 show a further sign of the invention which comprises a small sliding cursor between the upper sheet 3 and base layer 2 of the sign, which cursor is operated to separate or release the upper sheet 3 from the base layer, instead of the previously described finger wipe action. As before, the sign comprises an upper sheet 3 and a base layer 2 on a backing sheet 1. The particular version shows in FIGS. 19 and 20 is similar to the sign of FIGS. 1 to 4 in that a base layer icon or indicia is visible when the upper sheet 3 is caused to adhere to the base layer 2, and is made substantially less visible or generally invisible when the upper sheet 3 is released from the base layer 2, by sliding of the cursor between the two as will be described. To form the base layer 2 in this embodiment an icon or indicia which in this case is the series of letters A, B, C, D is ink printed on the backing sheet as indicated at 2*d* and the base layer 2 comprises a coating of clear or near clear wax or similar over the whole of the backing sheet. The upper sheet 3 extends over the base layer 2 as shown. A small frame 8, formed of plastic for example, is provided to the sign as shown and is fixed about the periphery of the backing sheet 1. The sign is visible through a large window in the frame 8 as shown. A small plastic cursor 7 extends across the sign between the upper sheet 3 and base layer 2 as shown. At its either end the cursor is captured within a slot extending substantially the length of the frame 8 on either side.

To cause the base layer icon or indicia to be displayed, the upper sheet 3 is pressed to adhere to the base layer 2 so that the base layer icon or indicia becomes visible through the upper sheet 3, by repeatedly running a finger nail or stylus or similar over the upper sheet 3 within the window in the frame 8. To subsequently erase the icon or indicia or cause it to become less visible, the cursor 7 is slid in the direction of arrows I from one end of the sign to the other and back. As the cursor moves between the upper sheet 3 and the base layer 2 it will separate same.

The particular version of signs shown in FIGS. 19 and 20 is similar to that of FIGS. 1 to 5 except that the sign of FIGS. 19 and 20 uses cursor erasure instead of finger wipe erasure. It will be appreciated that a sliding cursor instead of a finger wipe action could be used in any sign of the invention including those if FIGS. 6 to 9, 10 to 13, and 14 to 18. Also, other erasure systems may be utilised, such as joining the upper sheet to the base layer or backing sheet along one edge only so that the upper sheet can be physically lifted to erase the sign.

Signs of the invention are preferably formed as a sealed unit thereby preventing the ingress of contaminates and improving mechanical robustness and structural integrity of the label. However, small air vents may be provided in the form of one or more slits or pinholes near the periphery of product such as at or near either end for example, which can assist in easy finger wipe action of the product, and also as mentioned the upper sheet does not necessarily need to be fixed to the base layer about the entire periphery of the base layer so long as it is fixed along at least most of two opposite sides. The wiping action employed in use assists in redistributing the wax or other material of the base layer into any cavities formed by localised pressure during writing thus extending the life of the erasable product.

Preferably in manufacture of products of the invention, the upper sheet 3 is applied to the base layer with little tension or minimal tension in the material forming the upper sheet (but without excess slack in the upper sheet). For example, while the upper sheet may be subjected to slight tension in the manufacturing process which will take up some of any inherent elasticity in the material of the upper sheet, it is undesirable for the material to be put under such tension as will take up most of the inherent elastic extension that may be available with the material. Also, it is desirable that the upper sheet be laid onto the base layer without excess air between the base layer and the upper sheet, but at the same time air does not need to be evacuated from between the upper sheet and the base layer.

The foregoing describes the signs of the invention and preferred forms thereof. Alterations and modifications and combinations of features not specifically described as will be obvious to those skilled in the art are intended to be incorporated within the scope hereof as defined in the accompanying claims.

We claim:

1. A sign comprising a substantially clear base layer, a contrasting icon or indicia on a surface below the base layer, and an upper sheet extending over the base layer, the upper sheet and the base layer being releasably adhered together under pressure applied on the upper sheet, and the icon or indicia being visible through the upper sheet when the upper sheet is caused to releasably adhere to the base layer and being substantially less visible when the upper sheet is released from the base layer.

2. A sign according to claim 1, wherein the upper sheet and base layer are sufficiently releasably adhered together such that the upper sheet can be caused to release from the base layer so that the icon or indicia can be made substantially less visible when a users finger or thumb is wiped across a top surface of the upper sheet to release the upper sheet from the base layer.

3. A sign according to claim 2, wherein the upper sheet also extends over a wipe-start region adjacent the base layer in which said region the upper sheet and the base layer are not adhered together, and over which said region a users finger or thumb may be placed to begin wiping movement to separate the upper sheet from the base layer.

4. A sign according to claim 3, wherein material comprising the base layer is not provided beneath the upper sheet in said wipe-start region to form the wipe-start region in which the upper sheet and base layer are not adhesive together.

5. A sign according to claim 2, wherein the upper sheet comprises a transparent or translucent material.

6. A sign according to claim 2, wherein the upper sheet is fixed to a surface carrying the base layer about all peripheral sides of the upper sheet and the upper sheet provides a smooth and substantially wrinkle free top surface.

* * * * *